US008707497B2

(12) United States Patent
Liu

(10) Patent No.: US 8,707,497 B2
(45) Date of Patent: Apr. 29, 2014

(54) COMBINATION VACUUM CLEANER, DOLLY, AND MOUNTING BRACKET

(75) Inventor: Li H. Liu, South Williamsport, PA (US)

(73) Assignee: Shop Vac Corporation, Williamsport, PA (US)

( * ) Notice: Subject to any disclaimer, the term of this patent is extended or adjusted under 35 U.S.C. 154(b) by 561 days.

(21) Appl. No.: 12/616,290

(22) Filed: Nov. 11, 2009

(65) Prior Publication Data

US 2011/0107547 A1 May 12, 2011

(51) Int. Cl.
*A47L 11/00* (2006.01)

(52) U.S. Cl.
USPC ..... 15/32

(58) Field of Classification Search
USPC ..... 15/327.2, 336, 246.2, 246.4; 248/205.1, 248/207, 217.1, 316.7, 309.1
See application file for complete search history.

(56) References Cited

U.S. PATENT DOCUMENTS

| | | | | |
|---|---|---|---|---|
| 3,286,446 | A | 11/1966 | Happe et al. | |
| 4,573,234 | A * | 3/1986 | Kochte et al. | 15/323 |
| 4,650,200 | A | 3/1987 | Berfield et al. | |
| 4,670,701 | A * | 6/1987 | Sako et al. | 320/115 |
| 5,528,794 | A | 6/1996 | Tomasiak | |
| D395,119 | S | 6/1998 | Berfield | |
| D414,305 | S | 9/1999 | Rohn et al. | |
| D429,394 | S | 8/2000 | Griffin et al. | |
| 6,237,187 | B1 * | 5/2001 | Hult et al. | 15/323 |
| 6,557,206 | B1 * | 5/2003 | Liu | 15/327.5 |
| D568,562 | S | 5/2008 | Griffin et al. | |
| D568,564 | S | 5/2008 | Griffin et al. | |
| D568,565 | S | 5/2008 | Griffin et al. | |
| D571,513 | S | 6/2008 | Griffin et al. | |
| D581,114 | S | 11/2008 | Crevling, Jr. et al. | |
| 7,555,809 | B2 | 7/2009 | Liu | |
| D602,661 | S | 10/2009 | Griffin et al. | |
| 2009/0026721 | A1 | 1/2009 | Martinez | |

OTHER PUBLICATIONS

International Preliminary Report on Patentability for corresponding International Application No. PCT/US10/55344, dated May 15, 2012.

International Search Report and Written Opinion from corresponding International Application No. PCT/US2010/055344, dated Feb. 23, 2011.

* cited by examiner

*Primary Examiner* — Todd Manahan
*Assistant Examiner* — Brianne Kalach
(74) *Attorney, Agent, or Firm* — Marshall, Gerstein & Borun LLP

(57) ABSTRACT

The disclosed bracket can be used to hang vacuum cleaners that have a detachable dolly. A plate on the bracket mounts to a wall. A stem portion fits within a slot on the dolly. Lower wall segments on the stem portion extend from the wall plate and have vertical outer edges. Intermediate wall segments extend between the lower wall segments and upper wall segments that have lower horizontal limits that are closer together than the lower wall segments are, are positioned laterally outwards from the stem portion, and taper toward each other above their lower limits. Side rim portions extend from the upper wall segments and fit within grooves on the vacuum cleaner. The outer edges of the lower wall segments are farther apart than the inner edges of the side rim portions are, and closer together than the outer edges of the side rim portions are.

11 Claims, 15 Drawing Sheets

COMBINATION VACUUM CLEANER, DOLLY, AND MOUNTING BRACKET

CROSS-REFERENCE TO RELATED APPLICATIONS

Not applicable.

BACKGROUND OF THE INVENTION

The present invention relates generally to vacuum cleaners, and more particularly to a mounting bracket that can be used for vacuum cleaners that can be attached to a wheeled dolly.

BRIEF SUMMARY

Storage of domestic cleaning products like vacuum cleaners is commonly a problem. Shop Vac Corporation was previously granted U.S. Pat. No. 7,555,809 on a bracket that enables a conventional wet/dry vacuum cleaner to be hung on a wall. The disclosure of that application is incorporated by reference into this document.

The applicants have developed a new variant on that bracket that can be used to hang vacuum cleaners that have a detachable dolly. Like the earlier bracket, the new bracket uses side rim portions that are configured to fit within the angled grooves on the vacuum cleaner. Unlike prior known brackets, the new bracket has a stem portion that is configured to fit within a slot on the dolly when the dolly is fitted onto the vacuum cleaner. The stem portion has two lower wall segments that have parallel outer edges that define a vertical plane. The side rim portions are positioned laterally outwards from the outer edges of the stem portion, and extend from two upper wall segments that have lower horizontal limits that are closer together than the lower wall segments are.

The bracket has a wall plate that mounts to a vertical wall, and the lower wall segments diverge outwardly from the wall plate. The bracket also has intermediate wall segments that extend upwardly from the lower wall segments and outwardly from the wall plate. The upper wall segments taper toward each other above their lower horizontal limits, and the side rim portions of the bracket have inner edges that are closer together than the outer edges of the lower wall segments are. In contrast, the outer edges of the side rim portions are farther apart than the outer edges of the lower wall segments are.

BRIEF DESCRIPTION OF THE DRAWINGS

The invention may be better understood by referring to the accompanying drawings, in which.

DETAILED DESCRIPTION

Figure 1:
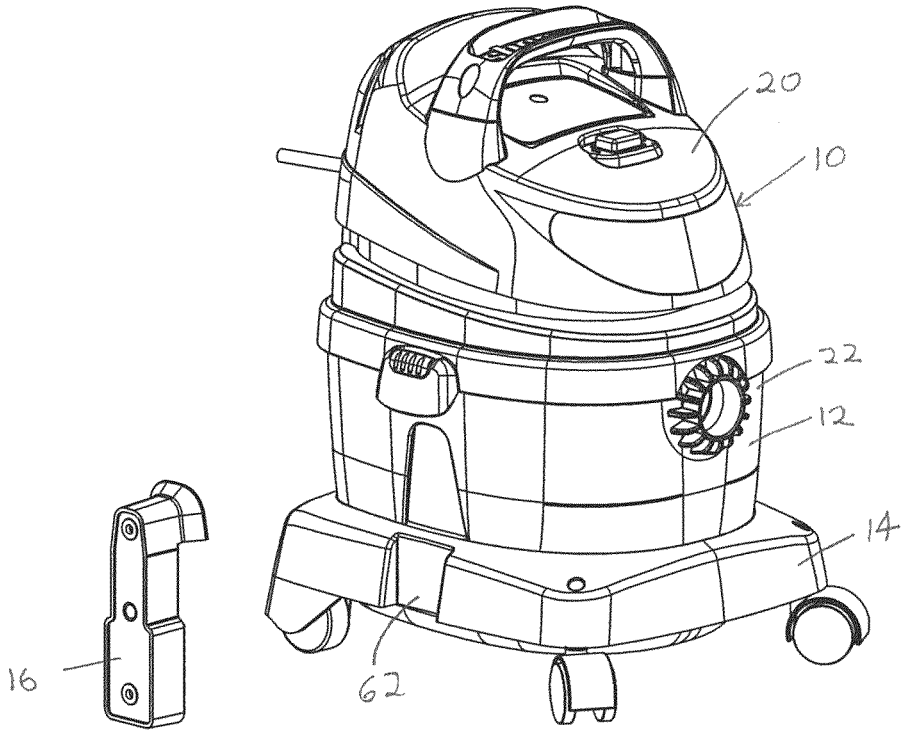
FIG. 1 is a perspective view of a vacuum cleaner, dolly, and wall bracket combination that incorporates one embodiment of the invention.

The vacuum cleaner, dolly, and bracket combination 10 seen in FIG. 1 is composed of a vacuum cleaner 12, a dolly 14, and a bracket 16. Each of these parts will be discussed in more detail below.

The Vacuum Cleaner

Figure 2:
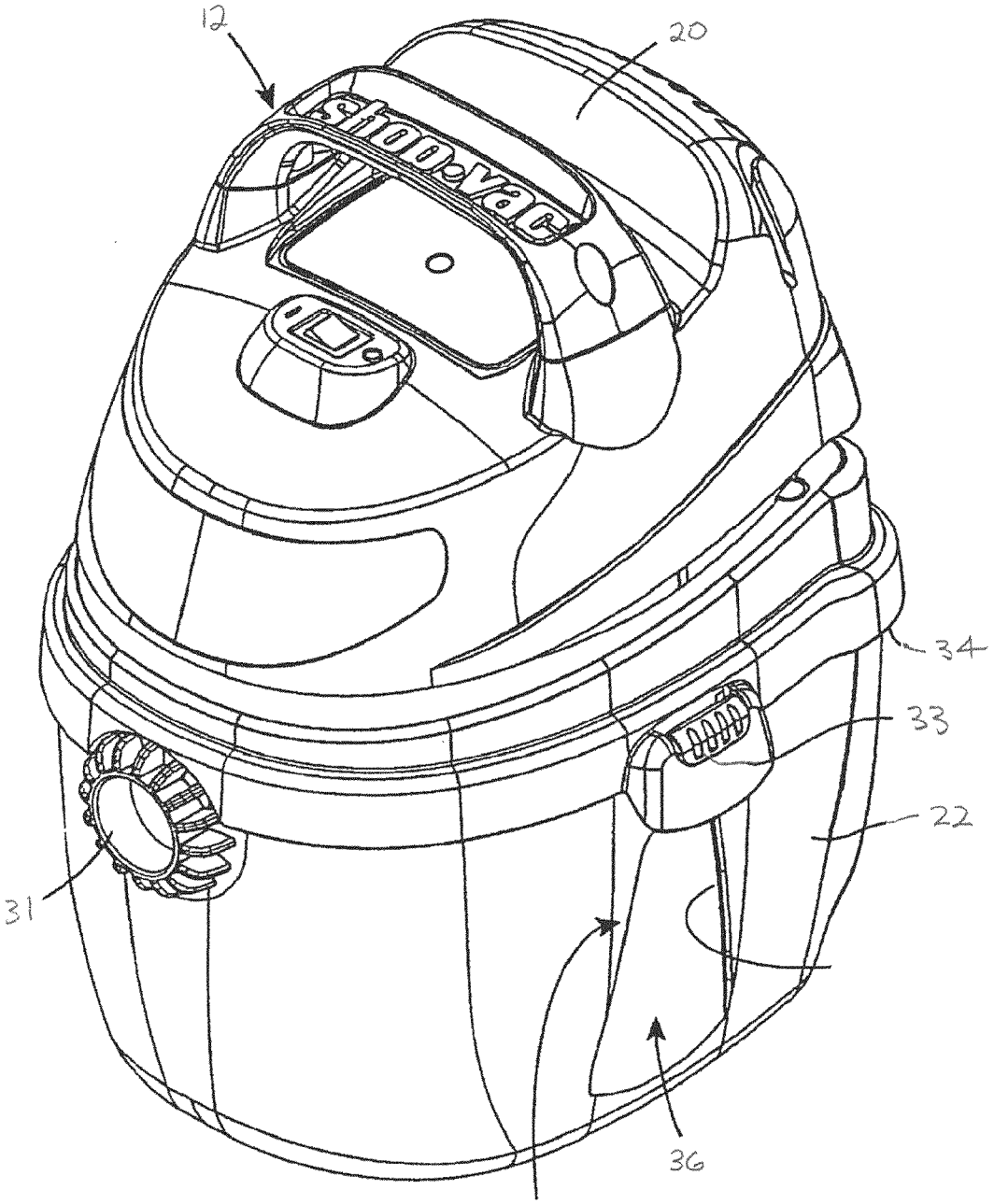
FIG. 2 is an enlarged perspective view of the vacuum cleaner seen in FIG. 1.

The invention can be used with many types of vacuum cleaners. The vacuum cleaner 12 seen in FIG. 2 is a wet/dry vacuum cleaner, and has a capacity in the range of 1½ gallons to 6 or more gallons. It has both a vacuum head 20 and a separable vacuum tank 22. The illustrated vacuum head 20 powers the vacuum cleaner. The internal components of the illustrated vacuum cleaner, including a motor and an air impeller (not depicted), are conventional. The head mounts onto and seals against the vacuum tank.

Figure 3:
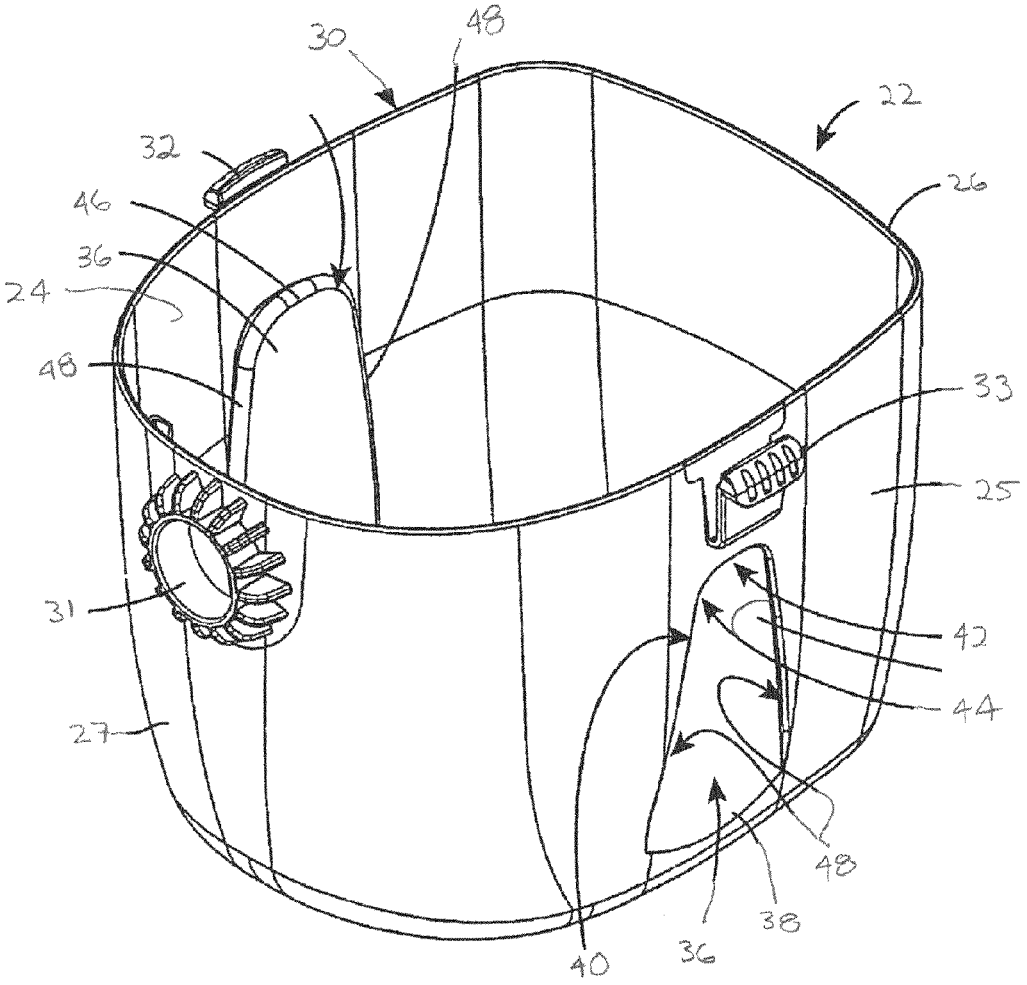
FIG. 3 is a perspective view of the tank of the vacuum cleaner of FIG. 2
Figure 4:
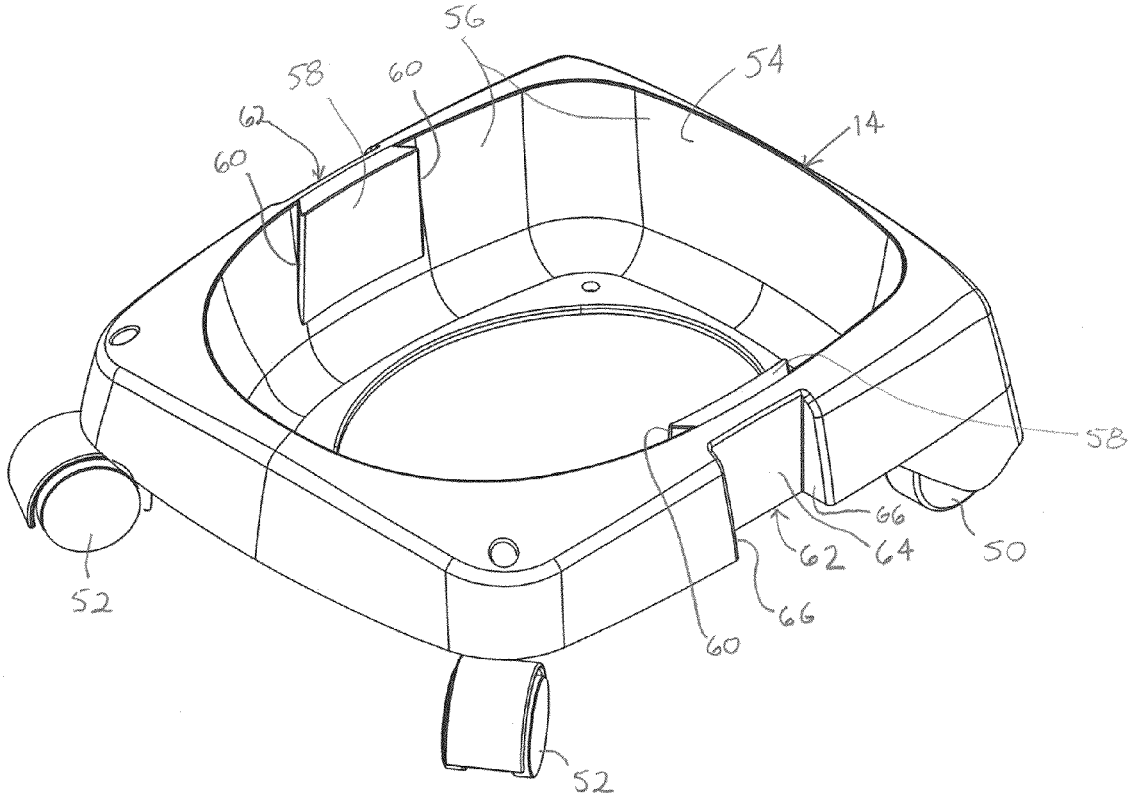
FIG. 4 is a perspective view of the dolly seen in FIG. 1.
Figure 5:
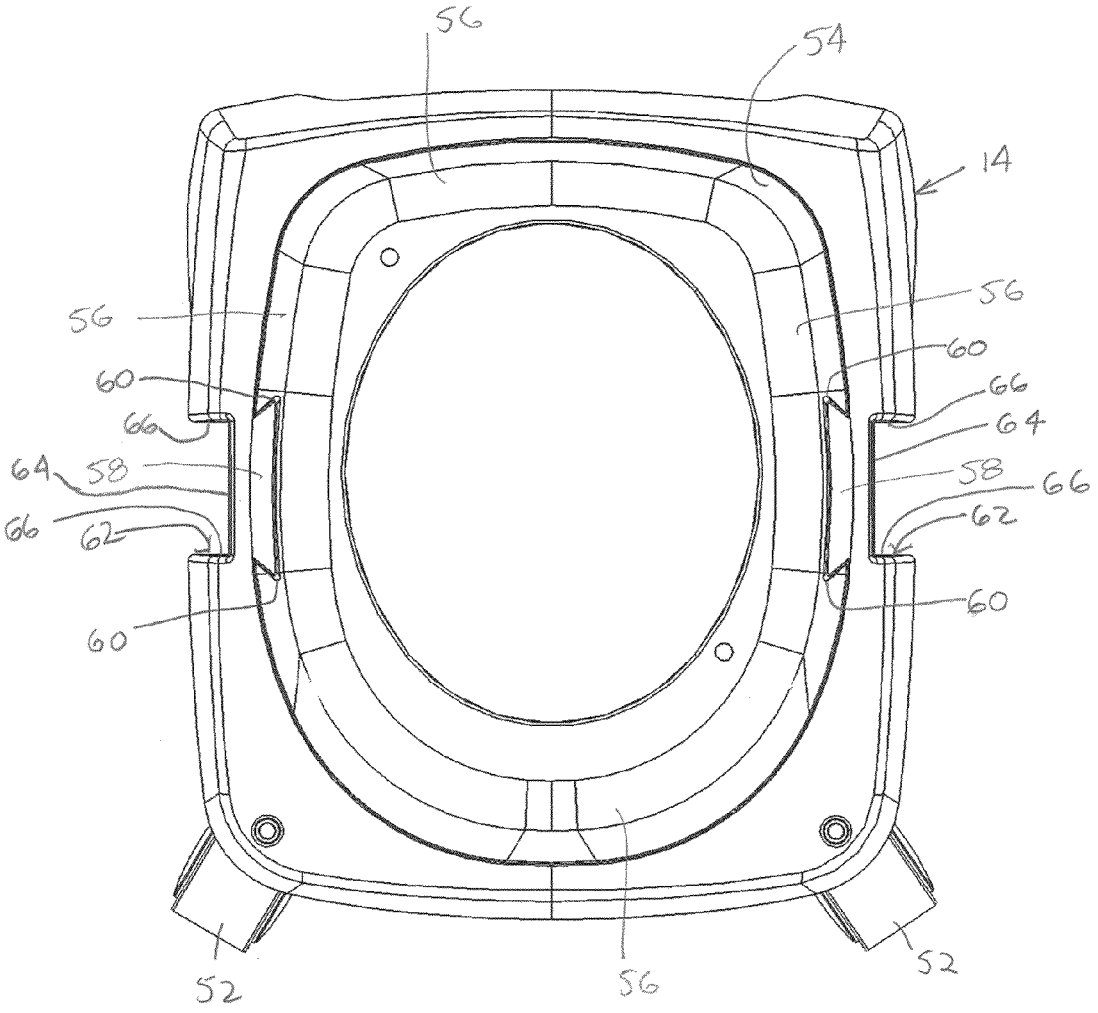
FIG. 5 is a top plan view of the dolly.

The tank 22 holds debris collected by the vacuum cleaner. The tank seen in FIG. 3 is manufactured as a single piece of rigid plastic. Single-piece construction can minimize the amount of time and effort to produce the tank. It may also be preferred for forming the angled grooves. However, one-piece construction is not always required. In some circumstances, two-piece tanks or other designs may also be used. Rigid plastic is conducive to true one-piece construction, and may sometimes be preferred for that reason. However, a variety of materials other than rigid plastic can also be used.

For reference, the illustrated tank 22 seen in FIG. 3 can be viewed as having a right side 24, a left side 25, a rear side 26, and a front side 27. A rim 30, an inlet 31, a right latch 32, and a left latch 33 are molded into the illustrated tank.

The rim 30 on the illustrated tank 22 is profiled to correspond with a lip 34 (FIG. 2) on the bottom of the vacuum head 20. The right latch 32 is spaced away from the right side 24 of the tank and the left latch 33 is spaced away from the left side 25. This arrangement provides enough room for the lip of the vacuum head to seal against the rim 30 of the tank.

The inlet 31 is used for attaching a hose to the illustrated vacuum cleaner 12, and may have a conventional design. The illustrated inlet has a reinforced design, and can withstand the forces associated with installing and removing the vacuum hose from the tank 22 during use.

The right and left sides 24 and 25 of the illustrated vacuum cleaner 12 each have an indentation 36 that can be used for mounting the vacuum cleaner to the illustrated bracket 16. The indentation could also be on other sides of the tank 14, or on other parts of the vacuum cleaner, such as a side on the illustrated vacuum head 20. While two indentations are shown in this example, only one indentation may be needed.

As seen in FIG. 3, a lower portion 38 of the illustrated indentation 36 is nearly flush with the corresponding side 24, 25 of the vacuum cleaner 12. An upper portion 40 of the indentation has a downwardly-facing upper lip portion 42 and two opposed laterally-facing side lip portions 44. An upper groove 46 can be found behind the upper lip portion, and a side groove 48 can be found behind each side lip portion. The outward face of the grooves (the back wall of the lip portions) is angled with respect to the plane of the side.

For manufacturing ease, the side lip portions 44, the upper lip portion 42, and adjacent portions of the illustrated vacuum cleaner 12 are all part of an integral molding. This is not always required. The lip portions could, for example, be formed on separate metal or plastic pieces that are connected (by screws or otherwise) to a wall of the vacuum cleaner.

In this example, the lip portions 42, 44 form a continuous lip that has a three-sided shape seen in FIGS. 2 and 3, with the side lip portions 44 and the corresponding grooves 48 being relatively linear and sloped with respect to each other so that the tops of the side lip portions and the grooves are spaced closer together than the bottoms of the side lip portions and the grooves. As explained below, the taper resulting from this arrangement (where the grooves are angled with respect to each other) may facilitate the mounting of the vacuum cleaner 12 onto the wall bracket 16. However, in some circumstances, this taper may not be required.

This illustrated vacuum cleaner has side lip portions 44 that face toward each other; in other words, there is an empty space in front of the vacuum cleaner 12 between the right edge of the left side lip portion and the left edge of the right side lip portion. In some circumstances, the side lip portions could be arranged to face away from each other, so that the right side of the left side lip portion and the left side of the right side lip portion are the sides that transition into the rest of the vacuum cleaner 10.

In this example, the side lip portions 44 both extend between ½" and 8" inches down from the lateral ends of the upper lip portion 42. This downward extension helps to provide lateral stability to the vacuum cleaner 12 while it is hung from the bracket 16.

The Dolly

The dolly 14 enables a user to slide the vacuum cleaner across a floor. The dolly illustrated in FIGS. 4-9 has four wheels or casters 50, 52 and a central opening 54. Although other arrangements are possible, the illustrated dolly is molded from plastic.

The two rear wheels or casters 50 are fixed in a parallel arrangement, while the two forward wheels or casters 52 are arranged on pivots that allow them to turn in different directions. Although other arrangements are possible, this arrangement is particularly useful in helping the user to move the dolly in desired direction.

The central opening 54 receives the vacuum cleaner 12. In the illustrated dolly 14, the internal sides 56 of the dolly slope inwardly and generally match the shape of the sides of the lower portions of the tank 22. This configuration enables the sides of central opening to hold the tank in a position between ½" and 5" above the floor. The dolly and the vacuum cleaner can be secured together in any conventional way, such as by the use of screws. Although the size of the dolly can vary, the illustrated dolly is between 2" and 12" in height, including the wheels or casters 50, 52.

The illustrated dolly has tongue sections 58 on the internal sides 56 of the central opening 54. These optional tongue sections have generally vertical lateral edges 60 that are configured to fit within the lower parts of the angled grooves 48 on the tank 22, helping to hold the tank and the dolly together. The illustrated tongue sections are between 1" and 5" across, and between ⅛" and 3" in thickness.

Figure 6:
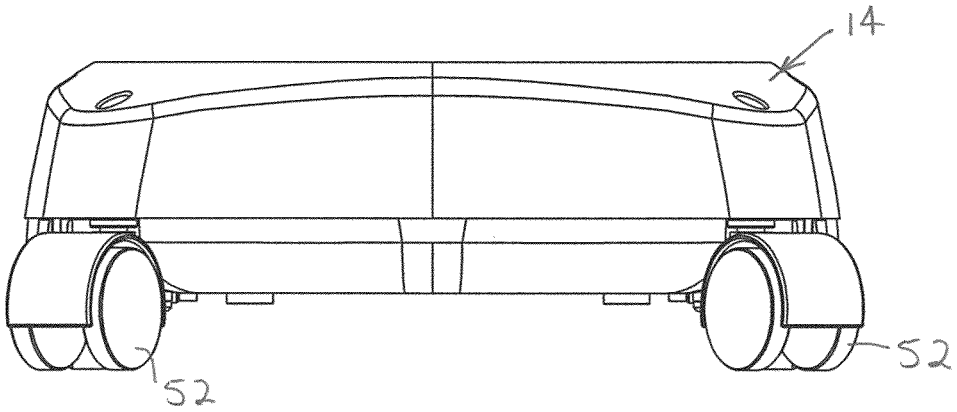
FIG. 6 is a front elevation of the dolly.
Figure 7:
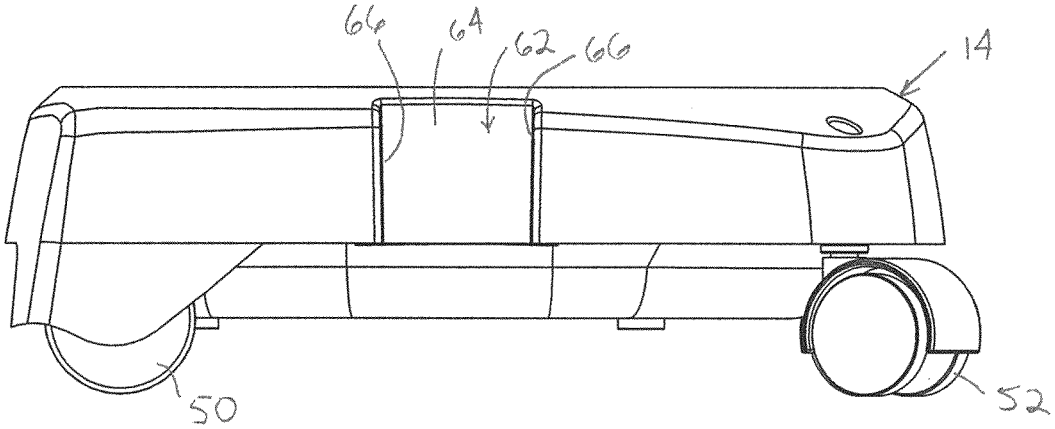
FIG. 7 is a left elevation of the dolly. The right elevation is a minor image of this view.
Figure 8:
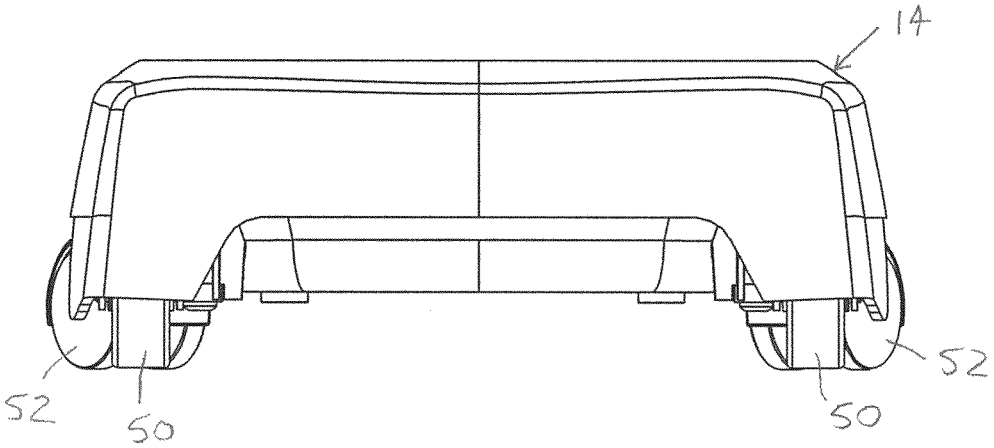
FIG. 8 is a rear elevation of the dolly.
Figure 9:
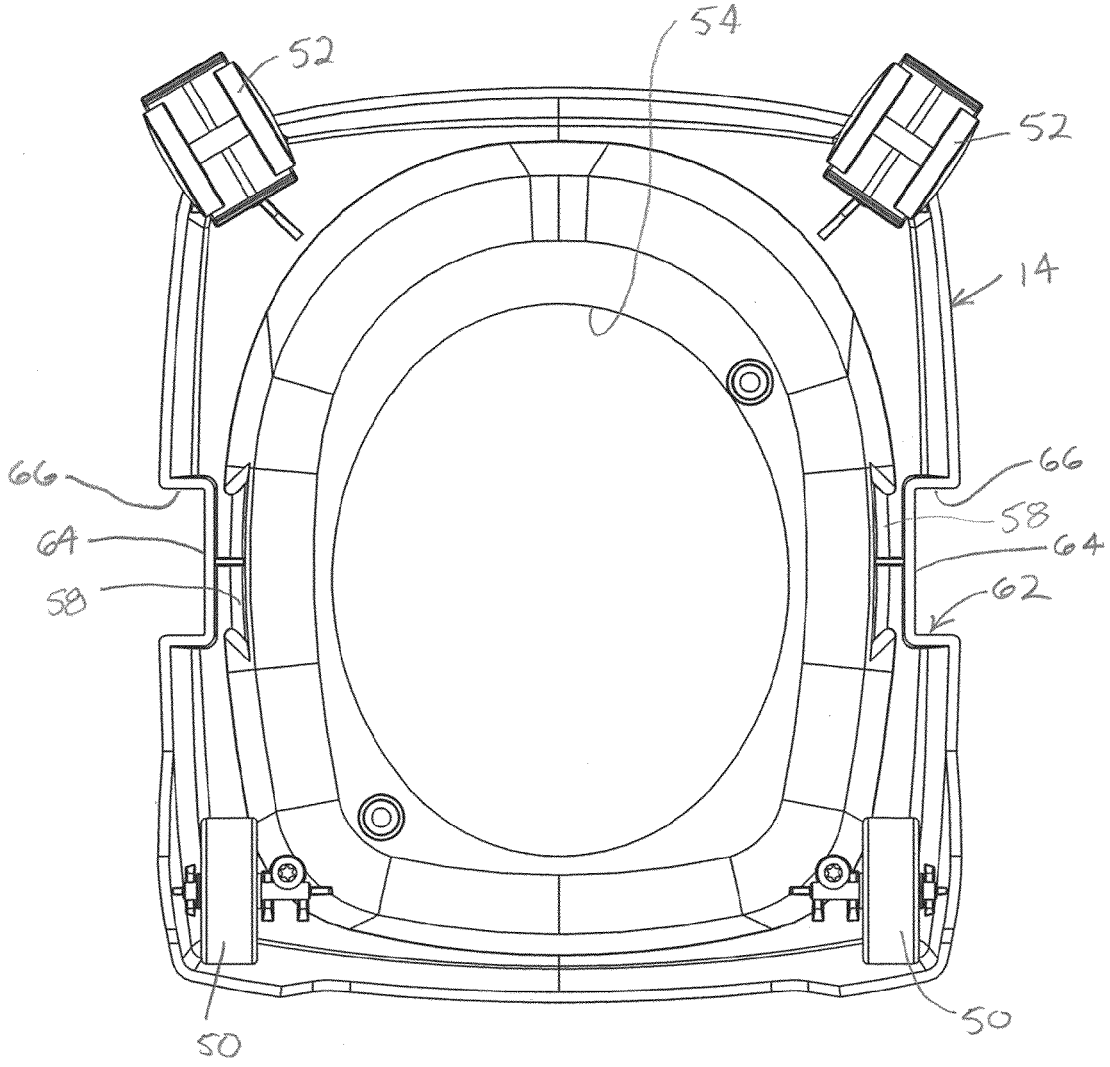
FIG. 9 is bottom plan view of the dolly.
Figure 10:
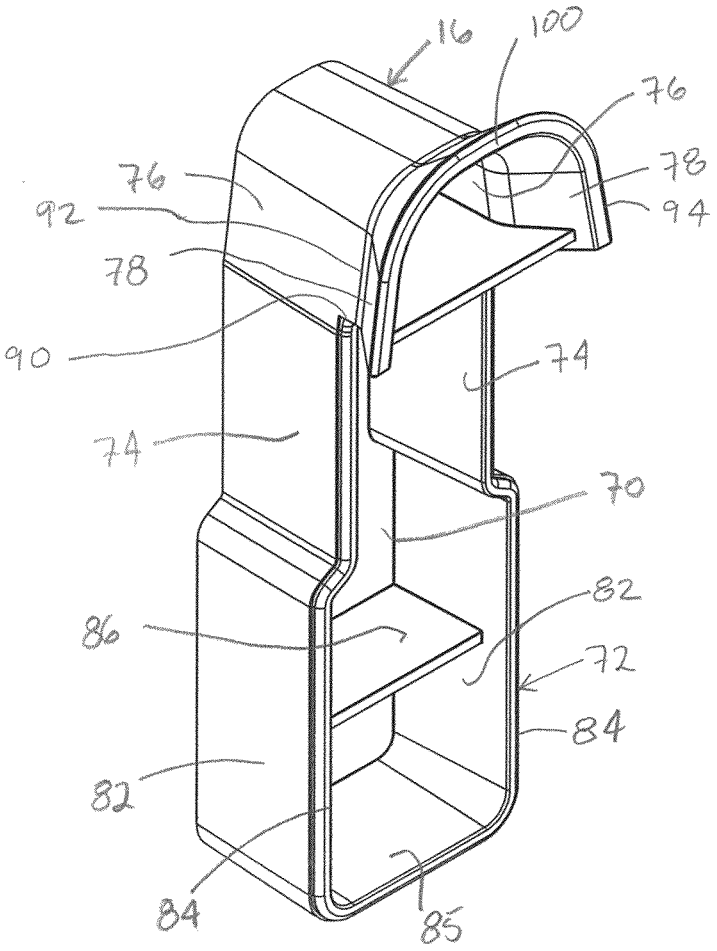
FIG. 10 is an enlarged perspective view of the bracket seen in FIG. 1.
Figure 11:
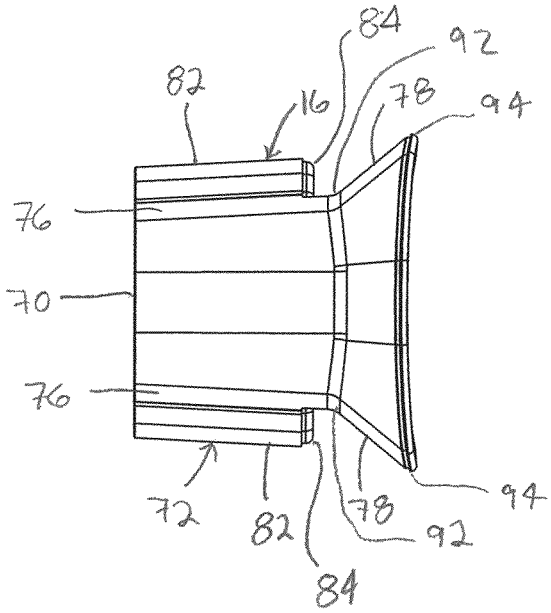
FIG. 11 is a top plan view of the bracket.
Figure 12:
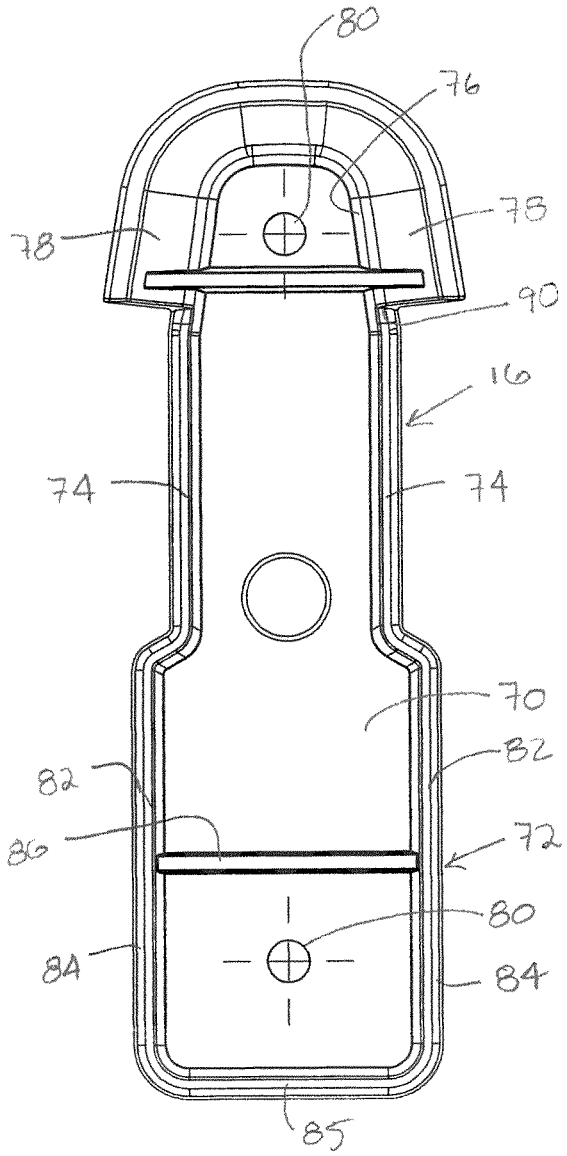
FIG. 12 is a front elevation of the bracket.
Figure 13:
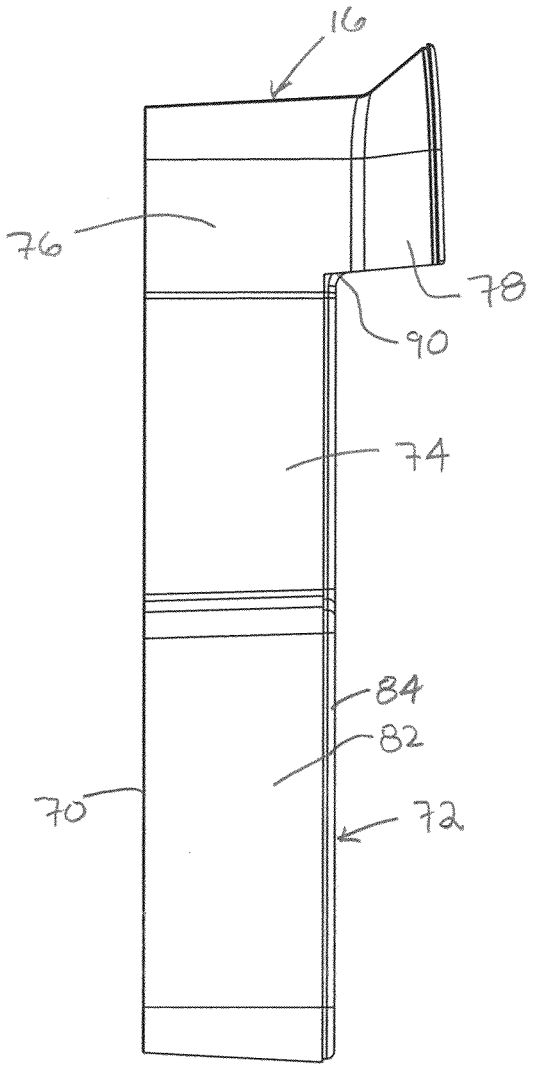
FIG. 13 is a side elevation of the bracket. The opposite elevation is a minor image of this view.
Figure 14:
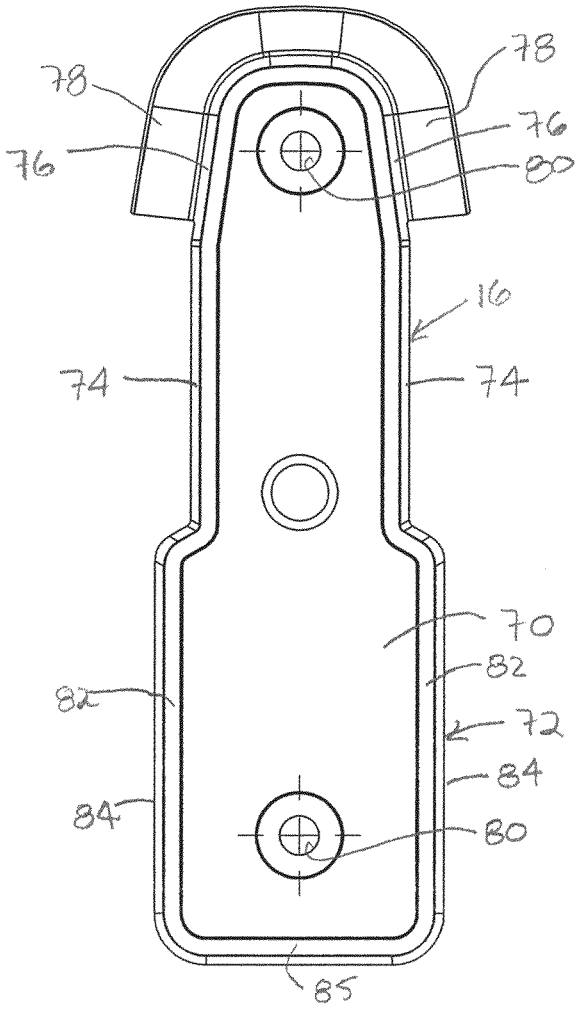
FIG. 14 is a rear elevation of the bracket.
Figure 15:
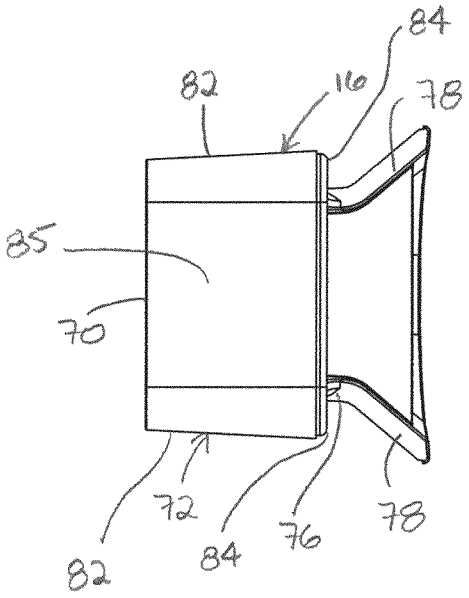
FIG. 15 is bottom plan view of the bracket.

The illustrated dolly 14 also has a slot 62 on both the right side and the left side. These slots are directly outside the optional tongue sections 58, and (as best seen in FIG. 6) each have a generally vertical back face 64 and two generally vertical opposed sides 66 that are generally parallel to each other and perpendicular to the back face. The configuration of these slots can vary, and will generally depend upon the configuration of the stem section described in the next section. The illustrated slots are between 1" and 5" across, and between ⅛" and 3" deep.

The Bracket

When the dolly 14 is connected to the vacuum cleaner 12, the combination can be suspended using the bracket 16. The bracket illustrated in FIGS. 10-15 can also be used to suspend the vacuum cleaner alone. Although the bracket can be made in a variety of different ways using a variety of materials (including, for example, steel), the illustrated bracket is molded from plastic. The illustrated bracket has a wall plate 70, a stem portion 72, intermediate wall segments 74, upper wall segments 76, and side rim portions 78. Each of these parts will be discussed in turn.

The wall plate 70 mounts to a vertical wall. The illustrated wall plate is planar, with openings 80 (FIGS. 12 and 14) that accommodate a fastener such as a screw or nail that can be used to secure the wall plate to the wall.

The stem portion 72 of the bracket 16 is configured to fit into the slot 62 on the dolly 14 when the vacuum cleaner 12 and the dolly are connected and the vacuum cleaner is suspended on the bracket. Although other arrangements are possible, the illustrated stem portion has two lower wall segments 82 that diverge outwardly from the wall plate 70. This divergence facilitates molding of the bracket. The illustrated wall segments have parallel outer edges 84 that define a vertical plane. These edges are configured to fit against the vertical back face 64 of the slot. The illustrated stem portion has wall segments that extend between ½" and 4" from the wall plate 70, and are spaced between 1" and 5" apart. An optional bottom wall segment 85 and a rib 86 connect the two wall segments on the stem portion, providing additional strength and rigidity.

The intermediate wall segments 74 are optional. Like the lower wall segments 82, the intermediate wall segments extend from and diverge outwardly from the wall plate 70, facilitating manufacturing. The illustrated intermediate all sections extend upwardly and laterally inwardly from the lower wall segments 82, with the upper end of the intermediate wall segments being spaced ½" to 3" closer together than the lower wall segments.

The upper wall segments 76 form the base for the rim portions 78 that are used to hold the vacuum cleaner 12 on the bracket 16. Like the lower wall segments 82 and the intermediate wall segments 74, the illustrated upper wall segments extend outwardly from the wall plate 70. These wall segments extend to and through the plane that is defined by the outer edges 84 of the lower wall segments. In this illustration, the upper wall segments are positioned between ⅛" and 2" inwardly of outer edges of the lower wall segments. The lower horizontal limits 90 (FIGS. 10 and 12) of the two upper wall segments (which, in this case, adjoin the intermediate wall segments 74) are positioned closer to each other than the lower wall segments are. In this example, the lower horizontal limits of the upper wall segments are between ⅛" and 3" closer together than the lower wall segments are. The illustrated upper wall segments also taper toward each other above their lower horizontal limits, being between ⅛" and 2" closer together at the top than at the bottom.

The side rim portions 78 of the bracket fit into the angled grooves 48 on the vacuum cleaner 12, and enable the bracket to hold and support the vacuum cleaner. The illustrated side rim portions extend outwardly from outer edges of the upper wall segments 76. In the illustrated example, the inner edges 92 of the side rim portions (FIG. 11) are closer together than the outer edges 84 of the lower wall segments 82 are. In contrast, the lower end of the outer edges 94 of the side rim portions extend farther apart than the outer edges of the lower wall segments.

The illustrated bracket 16 has an upper rim 100 that can carry at least a portion of the weight of the vacuum cleaner 12. To do this, the upper rim is configured to fit within the upper groove 46 on the side of the vacuum cleaner. The upper rim of the illustrated bracket extends upwardly and forwardly from the upper wall segments 76, and has a sloped rear face. The vertical spacing between the top of the wall plate 70 and the uppermost edge of the upper rim of the bracket is greater than the vertical width of the corresponding upper lip portion 42 on the vacuum cleaner, and the width of the upper portion of the groove 48 is greater than the thickness of the upper rim of the bracket.

The rim portions 78 on the illustrated bracket 16 can not only support at least some of the weight of the vacuum cleaner 12, they can also help to provide lateral stability when the vacuum cleaner is mounted on the bracket. To do this, the side rim portions are configured to fit within the grooves 48 on the vacuum cleaner. The side rim portions of the illustrated bracket extend laterally (in opposed directions) and are positioned forwardly from the back of the wall plate 70 of the bracket. The lateral spacing between the back of the wall plate and the outermost edge 94 of the side rim portions is greater than the thickness of the side lip portions 44 on the vacuum cleaner, and the corresponding parts of the grooves on the side of the vacuum cleaner are wider than the rim portions of the bracket.

The lowermost rim portions 78 of the illustrated bracket 16 are disposed at least several inches below the upper rim 100 of the bracket. With this spacing, the side rim portions of the bracket engage within the grooves 48 on the vacuum cleaner 12 when the upper rim 100 is engaged in the part of the groove 48 behind the upper lip portion 42.

Although it is not always necessary, the laterally-facing side rim portions 78 of the illustrated bracket 16 ascend toward each other; that is, the upper portions of the side rim portions are closer together than the lower portions are. When combined with the side rim portions extending away from each other, this configuration helps to provide a gradual locking of the illustrated vacuum cleaner 12 onto the bracket as the vacuum cleaner is lowered onto the bracket. A gradual locking is also aided by sloping back surfaces on the grooves 48 and on the rim portions of the bracket. As the rim slides into the groove, the sloping back surfaces slide together, creating a tighter fit.

Hanging the Vacuum Cleaner and the Dolly on the Bracket

To mount the illustrated vacuum cleaner 12 onto the illustrated bracket 16 while the dolly is attached to the vacuum cleaner, the vacuum cleaner 12 is first positioned with the upper rim 100 of the bracket 16 between the top and the bottom of one of the indentations 36 on the side of the vacuum cleaner. The vacuum cleaner is then lowered so that the rim portions 78 of the bracket fit into the grooves 48 on the vacuum cleaner. Simultaneously, the stem portion 72 of the bracket can be brought to rest within the slot 62 on the dolly 14. This contact may help to reduce torque where the rim portions fit in the grooves.

In this case, the taper of the groove 48 on the indentations 36 and the taper of the rim portions 78 of the bracket 16 both help to direct the wall bracket into the indentation so that it seats properly, and provide additional security. In other embodiments, one or the other of these components, or both, might not be tapered.

When the illustrated vacuum cleaner 12 is mounted on the illustrated bracket 16, it is in an inherently stable and secure position. The vacuum cleaner can be removed by lifting it upwardly to disengage the rim portions 78 from the grooves 48.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A vacuum cleaner and bracket combination that has:

a vacuum cleaner that has angled grooves behind two lip portions; and a wall-mountable bracket that has (a) a stem portion that has two lower wall segments that have parallel outer edges that define a plane;

(b) two upper wall segments that (i) have lower horizontal limits that are closer together than the lower wall segments are, (ii) have inner edges that are adjacent to the wall plate, (iii) have outer edges that are spaced farther from the plane of the wall than the outer edges of the lower wall segments are, and (iv) taper toward each other above their lower horizontal limits; and (c) side rim portions that (i) extend from outer edges of the upper wall segments, (ii) have inner edges that are adjacent to portions of the outer edges of the upper wall segments, (iii) have outer edges that are spaced farther from the wall plate than the respective inner edges are, and (iv) are configured to fit within the angled grooves on the vacuum cleaner in a manner for supporting at least some of the weight of the vacuum cleaner, and to hold the vacuum cleaner in a suspended position.

2. A combination as recited in claim 1, in which:

(a) the bracket has a wall plate that mounts to a vertical wall;

(b) the stem portion of the bracket has two lower wall segments that diverge outwardly from the wall plate;

(c) the bracket also has intermediate wall segments that (i) extend upwardly from the lower wall segments and (ii) extend outwardly from the wall plate; and (d) the side rim portions of the bracket (i) have inner edges that are closer together than the outer edges of the lower wall segments are and (ii) have outer edges that extend farther apart than the outer edges of the lower wall segments.

3. A vacuum cleaner, dolly, and bracket combination that has:

(a) a vacuum cleaner that has angled grooves behind two lip portions;

(b) a dolly that (i) fits onto the vacuum cleaner, (ii) has wheels or casters, and (iii) has a slot on an outer side; and (c) a wall-mountable bracket that (i) has upper wall segments that have inner edges that are positioned adjacent a wall and outer edges that are spaced farther from the wall than the outer edges of lower wall segments are, (ii) has side rim portions that have inner edges that are adjacent to portions of the outer edges of the upper wall segments and outer edges that are spaced farther from the wall than the respective inner edges are, and are configured to fit within the angled grooves on the vacuum cleaner in a manner for supporting at least some of the weight of the vacuum cleaner, and to hold the vacuum cleaner in a suspended position, and (iii) has a stem portion that is configured to fit within the slot on the dolly when the dolly is fitted onto the vacuum cleaner and the vacuum cleaner is suspended on the bracket.

4. A combination as recited in claim 3, in which:

(a) the bracket has a wall plate that mounts against a vertical wall;

(b) the stem portion of the bracket has two lower wall segments that extend outwardly from the wall plate to spaced outer edges; and (c) the spaced outer edges of the stem portion of the bracket are positioned on a plane that extends between the side rim portions of the bracket and the wall plate.

5. A combination as recited in claim 3, in which:

(a) the stem portion of the bracket has two lower wall segments that have parallel outer edges that define a plane;

(b) the upper wall segments have lower horizontal limits that are closer together than the lower wall segments are; and (c) the side rim portions of the bracket extend from outer edges of the upper wall segments.

6. A combination as recited in claim 3, in which:

(a) the stem portion of the bracket has two lower wall segments that have parallel outer edges that define a plane;

(b) the inner edges of the side rim portions are closer together than the outer edges of the lower wall segments are; and (c) the outer edges of the side rim portions extend farther apart than the outer edges of the lower wall segments.

7. A combination as recited in claim 3, in which:

the stem portion of the bracket has two lower wall segments that diverge outwardly from the wall.

8. A combination as recited in claim 3, in which:

(a) the bracket has a wall plate that mounts to a vertical wall;

(b) the stem portion of the bracket has two lower wall segments that have parallel outer edges that define a vertical plane;

(c) the upper wall segments have lower horizontal limits that are closer together than the lower wall segments are;

(d) the side rim portions of the bracket extend from outer edges of the upper wall segments;

(e) the inner edges of the side rim portions are closer together than the outer edges of the lower wall segments are; and (f) the outer edges of the side rim portions extend farther apart than the outer edges of the lower wall segments.

9. A combination as recited in claim 3, in which:

(a) the bracket has a wall plate that mounts to a vertical wall;

(b) the stem portion of the bracket has two lower wall segments that have parallel outer edges that define a vertical plane;

(c) the upper wall segments (i) have lower horizontal limits that are closer together than the lower wall segments are; and (ii) extend outwardly from the wall plate to and through the plane that is defined by the outer edges of the lower wall segments.

10. A combination as recited in claim 3, in which:

(a) the bracket has a wall plate that mounts to a vertical wall;

(b) the stem portion of the bracket has two lower wall segments that (i) diverge outwardly from the wall plate and (ii) have parallel outer edges that define a vertical plane;

(c) the bracket also has a intermediate wall segments that (i) extend upwardly from the lower wall segments and (ii) extend outwardly from the wall plate, and (d) the bracket also has two upper wall segments that (i) have lower horizontal limits that are closer together than the lower wall segments are;

(ii) extend outwardly from the wall plate to and through the plane that is defined by the outer edges of the lower wall segments, and (iii) taper toward each other above their lower horizontal limits; and (e) the side rim portions of the bracket extend from outer edges of the upper wall segments.

11. A combination as recited in claim 3, in which:

(a) the bracket has a wall plate that mounts to a vertical wall;

(b) the stem portion of the bracket has two lower wall segments that (i) diverge outwardly from the wall plate and (ii) have parallel outer edges that define a vertical plane;

(c) the bracket also has a intermediate wall segments that (i) extend upwardly from the lower wall segments and (ii) extend outwardly from the wall plate, and (d) the bracket also has two upper wall segments that (i) have lower horizontal limits that are closer together than the lower wall segments are;

(ii) extend outwardly from the wall plate to and through the plane that is defined by the outer edges of the lower wall segments, and (iii) taper toward each other above their lower horizontal limits; and (e) the side rim portions of the bracket (i) extend from outer edges of the upper wall segments, (ii) have inner edges that re closer together then the outer edges of the lower wall segments are, and (iii) have outer edges that extend farther apart than the outer edges of the lower wall segments.

* * * * *